US006839955B2

(12) United States Patent
Uchikoba et al.

(10) Patent No.: US 6,839,955 B2
(45) Date of Patent: Jan. 11, 2005

(54) METHOD OF MAKING A MULTILAYER INDUCTOR

(75) Inventors: Fumio Uchikoba, Tokyo (JP); Noriyuki Kojima, Tokyo (JP)

(73) Assignee: TDK Corporation, Tokyo (JP)

( * ) Notice: Subject to any disclaimer, the term of this patent is extended or adjusted under 35 U.S.C. 154(b) by 243 days.

(21) Appl. No.: 10/150,094

(22) Filed: May 20, 2002

(65) Prior Publication Data

US 2002/0167389 A1 Nov. 14, 2002

Related U.S. Application Data

(62) Division of application No. 09/632,213, filed on Aug. 3, 2000, now Pat. No. 6,404,318.

(30) Foreign Application Priority Data

Aug. 6, 1999 (JP) ..... 11-224640

(51) Int. Cl.[7] ..... H01F 7/06

(52) U.S. Cl. ..... 29/602.1; 29/592.1; 29/841; 29/851; 252/514; 336/200; 336/223; 336/232; 427/96; 427/126.3; 427/376.2; 228/248.1; 228/248.5

(58) Field of Search ..... 29/592.1, 602.1, 29/841, 851; 336/200, 223, 232; 427/96, 126.3, 376.2; 252/514; 228/248.1, 248.5

(56) References Cited

U.S. PATENT DOCUMENTS

| | | | | |
|---|---|---|---|---|
| 4,808,274 A | | 2/1989 | Nguyen | 204/15 |
| 4,859,238 A | * | 8/1989 | Weise et al. | 75/233 |
| 5,096,619 A | * | 3/1992 | Slack | 252/514 |
| 5,515,022 A | | 5/1996 | Tashiro et al. | 336/200 |
| 6,160,465 A | | 12/2000 | Yamaguchi et al. | 336/110 |

FOREIGN PATENT DOCUMENTS

| | | | | |
|---|---|---|---|---|
| JP | 55151320 A | * | 11/1980 | C09D/5/24 |
| JP | 02082407 A | * | 3/1990 | H01B/1/22 |
| JP | 04065807 A | * | 3/1992 | H01F/17/00 |
| JP | 4-336405 | | 11/1992 | |
| JP | 5-198439 | | 8/1993 | |
| JP | 5-205944 | | 8/1993 | |

OTHER PUBLICATIONS

"Polymeric conductive pastes as solder replacement for flip–chip attachment"; Maner, K.U.; Ang, S.S.; Schaper, L.W.; Brown, W.D.; IEEE Transactions on vol.: 21, Issue: pp.:382–393.*

"A technology for high density mounting utilizing polymeric multilayer substrate"; Takeuchi, M.; Yoshida, K.; Iida, A.; Ohdaira, H Electronic Manufacturing Technology Symposium; Apr. 26–28, 1989; pp.: 136–140.*

* cited by examiner

*Primary Examiner*—Peter Vo
*Assistant Examiner*—Paul D Kim
(74) *Attorney, Agent, or Firm*—Oblon, Spivak, McClelland, Maier & Neustadt, P.C.

(57) ABSTRACT

In the multilayer inductor, the substrate thereof is composed of a constituent belonging to spinel ferrite, and is furnished with internal conductors of a main constituent being silver at the interior of the substrate. The internal conductors are drawn outside of the substrate, and the drawn portions are provided with external electrodes. The internal conductors contain manganese and bismuth, and the manganese and bismuth contents at an interface between the internal conductors and the substrate are more than those of other ranges. $MnO_2$ of 0.02 to 0.1 wt % and $Bi_2O_3$ of 0.5 to 1.2 wt % are added to a paste of the main constituent being silver to be used to the internal conductors, and the paste is baked together with spinel ferrite material.

7 Claims, 7 Drawing Sheets

METHOD OF MAKING A MULTILAYER INDUCTOR

BACKGROUND OF THE INVENTION

The invention relates to a multilayer inductor which has internal conductors of a main constituent being silver at the interior of the substrate thereof composed of a constituent belonging to spinel ferrite for attenuating noise elements, and a production method thereof.

In electronic machines, element mounting densities have kept on overcrowd, and there have been actualized mutual interference between elements or problems concerned with radiation of noises. Noise controlling means of many cases are higher harmonics of used signals, and attentions are paid to controlling of the higher harmonics. As the noise controlling means, there are multilayer inductors called as beads employing ferrite magnetic materials, means which shelters areas of circuit with metal plates to prevent bad influences to other circuit blocks, or means for avoiding spreading of noises to a next step by an LC resonance circuit.

Among them, according to the filter, a noise is not controlled, but the noise element is reflected to a front step and unexpected bad influences such as oscillation are given to the circuit, but since a multilayer inductor of noise absorption type does not cause such matters, it has been broadly used as a measure against noise.

A ceramic magnetic substance enabling to be sintered at around 900° C. and internal conductors composed of silver or its alloy are combined and baked together with the multilayer inductor so as to form coil shaped conductors at the interior of the ceramic sintered body. By shaping the internal conductors in coil, impedance may be made large, and loss of materials can be efficiently avoided, and as a result, the shape of the element can be made small sized.

Ferrite to be used to such purpose is called as spinel ferrite and it is almost composed of $NiCuZnFe_2O_4$ based component, and when using spinel ferrite, this kind of ferrite is sensitive to stress and an apparent permeability $\mu$ receives influence of stress and is remarkably lowered.

The multilayer inductor is baked together with silver powder for the internal conductors and ferrite powder for the substrate, and united in a one body. Since the silver is larger than the ferrite ceramic in coefficient of linear expansion, stress is, therefore, caused at the interface between silver and ferrite by baking together with, and the apparent $\mu$ of the ferrite is considerably lowered. Further, the interface therebetween is breakable, and the stress at the interface is released when heat-treating as soldering, so that problems occur that the apparent permeability $\mu$ is changed each time of the heat treatment and the characteristics are unstable.

For solving the problems, in JP-A-4-65807, a space 3 is defined as seen in FIG. 7 between the internal conductors 2 made of silver and the substrate 1 made of ferrite, thereby easing the stress exerting between the silver internal conductor 2 and the substrate 3 so as to improve the permeability $\mu$. Numeral 4 designates external electrodes connected to both ends of the internal conductors.

However, as the multilayer inductor is based on a premise of the mounting by soldering, it is necessary to perform an electrolytic plating on the external electrodes 4, and a plating liquid goes into the space 3 between the internal conductor and the substrate. The plating liquid has an etching effect to ferrite and various bad influences to the ferrite substrate.

SUMMARY OF THE INVENTION

In view of the above mentioned problems, it is accordingly an object of the invention to offer multilayer inductors stable in characteristics and a production method thereof, in which a spinel ferrite is a substrate and silver or its alloy is internal conductors, thereby to ease stress between the internal conductors and the substrate.

A multilayer inductor of a first aspect of the invention carries conductors of a main constituent being silver at an interior of a substrate composed of a constituent belonging to spinel ferrite, said internal conductors being drawn outside of the substrate, and the drawn portions are provided with external electrodes, and is characterized in that manganese and bismuth are contained in the internal conductors, and the manganese and bismuth contents at an interface between the internal conductors and the substrate are more than those of other ranges.

In the invention, manganese and bismuth are interposed between the internal conductors and spinel ferrite as the substrate for moderating stress. This fact may be explained as follows. A manganese element is in general included in a ferrite crystal lattice as known in MnZn ferrite. It is known that MnZn ferrite is less effected with stress in comparison with NiCuZn ferrite used in the invention. However, MnZn ferrite is higher in a sintering temperature than a melting point of silver as the internal conductor used in the invention, and it is assumed that a portion is made where the sintering is not partially progressed with only addition of manganese.

On the other hand, bismuth is known to lower the temperature of the sintered ferrite. In the invention, it is possible to provide such a multilayer inductor where the sintering does not progress with only addition of manganese, but by adding bismuth, a sintering at lower temperature is available, enabling to use silver as the internal conductor. Thus, the closeness of the inductor advances, so that stress at the interface is relieved.

A method of producing the multilayer inductor of a second aspect of the invention, is characterized in that $MnO_2$ of 0.02 to 0.1 wt % and $Bi_2O_3$ of 0.5 to 1.2 wt % are added to a paste of a main constituent being silver to be used to the internal conductors, and the paste is baked together with spinel ferrite material.

In the production method of the invention, if an addition content of $MnO_2$ s less than 0.02 wt %, impedance before the plating is lowered, and as a result, the changing rate of impedance before and after the plating is large, and the changing rate of a soldering heat resistance test is also large. On the other hand, if being higher than 0.1 wt %, acquisition impedance is considerably lowered. A preferable addition amount of $MnO_2$ is 0.05 wt % to 0.07 wt %.

On the other hand, if the addition amount of $Bi_2O_3$ is less than 0.5 wt %, the impedance before the plating is low and the changing rate of the impedance before and after the plating is large, and the changing rate of the impedance at the soldering heat resistance test is also large. If the addition amount of $Bi_2O_3$ is more than 1.2 wt %, the acquisition impedance is also remarkably lower. The more preferable addition amount of $Bi_2O_3$ is 0.8 wt % to 1.0 wt %.

DETAILED DESCRIPTION OF THE PREFERRED EMBODIMENTS

Figure 1A:
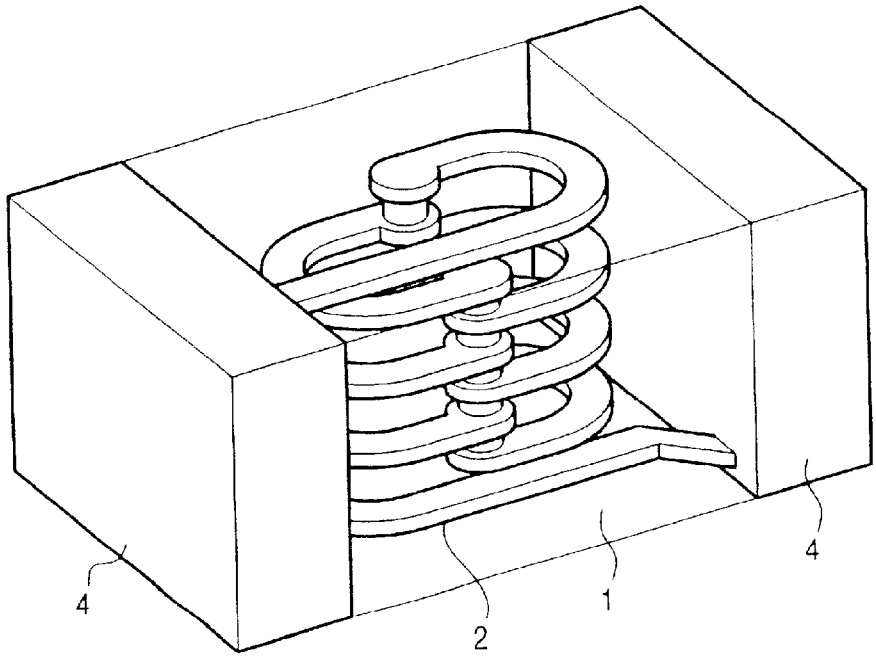
FIG. 1 is a perspective view showing one embodied mode of the multilayer inductor according to the invention, and B is partially cross sectional thereof view.
Figure 1B:
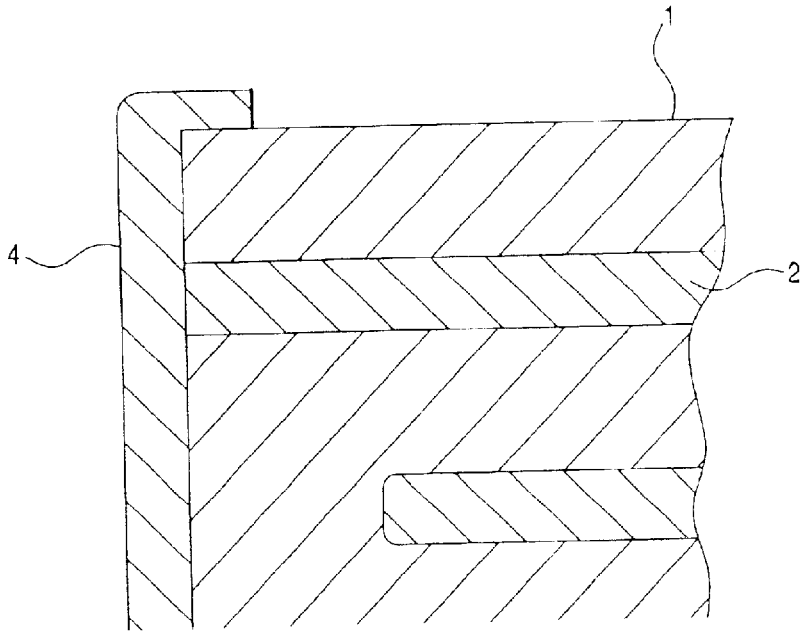

FIG. 1A is a perspective view showing one embodied mode of the multilayer inductor according to the invention, and FIG. 1B is partially cross sectional thereof view. With respect to the laminated ferrite inductor, internal conductors 2 of a main constituent being silver are carried in laminate structure at the interior of the substrate 1 composed of a spinel ferrite, said internal conductors being drawn outside of the substrate 1, and the drawn portions are provided with external electrodes 4. The internal conductor 2 is not always formed in coil, but often formed in straight or curve. Otherwise, a plurality of internal conductors are composed as an array by arranging in the same or complement layer.

In the multilayer inductors of the invention, amounts of $MnO_2$ and $Bi_2O_3$ to be added to the internal conductors were variously changed so as to investigate addition amounts, changes of the impedance before and after the plating and before and after the soldering tests. As to the multilayer inductors to be offered to the tests, the spinel ferrite was prepared as follows. At first, NiO, CuO, ZnO and $Fe_2O_3$ were weighed to predetermined composition rates, a pulverization was carried out for 6 hours in a water of a ball mill, passed through a 20 mesh sieve after drying, and subjected to a heat-treatment at 780° C. for 2 hours. The obtained samples were again pulverized for 16 hours, passed through the 20 mesh sieve after drying, and made ceramic powder. When examining impurities in the powder by a fluorescence X-ray, bismuth was not detected and manganese was around 0.002 wt %.

The obtained slurry was cast on a mold releasing film by the doctor blade method so as to obtain a green sheet of 40 $\mu$m thickness. The green sheet was formed at predetermined positions with through-holes, and subsequently, coil pattern formation and filling of the conductor paste into the through-holes were performed at the same time by a screen process printing.

Silver powder of an apparent density of 4 g/cm$^3$ and a specific surface area of 0.5 m$^2$/g, $MnO_2$ and $Bi_2O_3$ of the predetermined amounts, and ethylcellulose based binder previously melted in an organic solvent were weighed respectively, and mixed by three-rolls to produce a paste of internal conductors.

Substituting for the silver paste, silver-palladium alloy (Pt 4 wt %) having the same powder characteristics as the silver paste was made a paste as the silver paste. The paste was adjusted to have viscosity of around 100 cps by the viscosity of the organic solvent. A printing pressure was adjusted such that a print coating thickness was 15 $\mu$m.

Several sheets of the green sheets were piled, pressed under pressure of around 1 ton/cm$^2$, and cut out to be elements one by one. The cut elements were baked 200° C. for 2 hours, and united in one body. The elements were 11 layers, and the space per one layer was around 34 $\mu$m, and the thickness of the internal conductors was around 10 $\mu$m.

At this stage, the baked samples were buried in the resin by 10 pieces, followed by grinding after solidification, observed at the ground phases by a microscope so as to examine peelings at the interface between the internal conductor 2 and the substrate 1. The invention did not provide spaces at the interface as shown in JP-A-4-65807, and no peeling at the interface was observed in all the samples.

After cutting into chips, each of the chips was subjected to a barrel grinding, the external electrodes 4 were coated and baked, thereafter performed with the electroplating, and the impedance (100 MHz) before and after the electroplating was measured. Further, the samples were immersed in the soldering layer at 260° C. for 100 seconds for measuring changes of the impedance.

Figure 2:
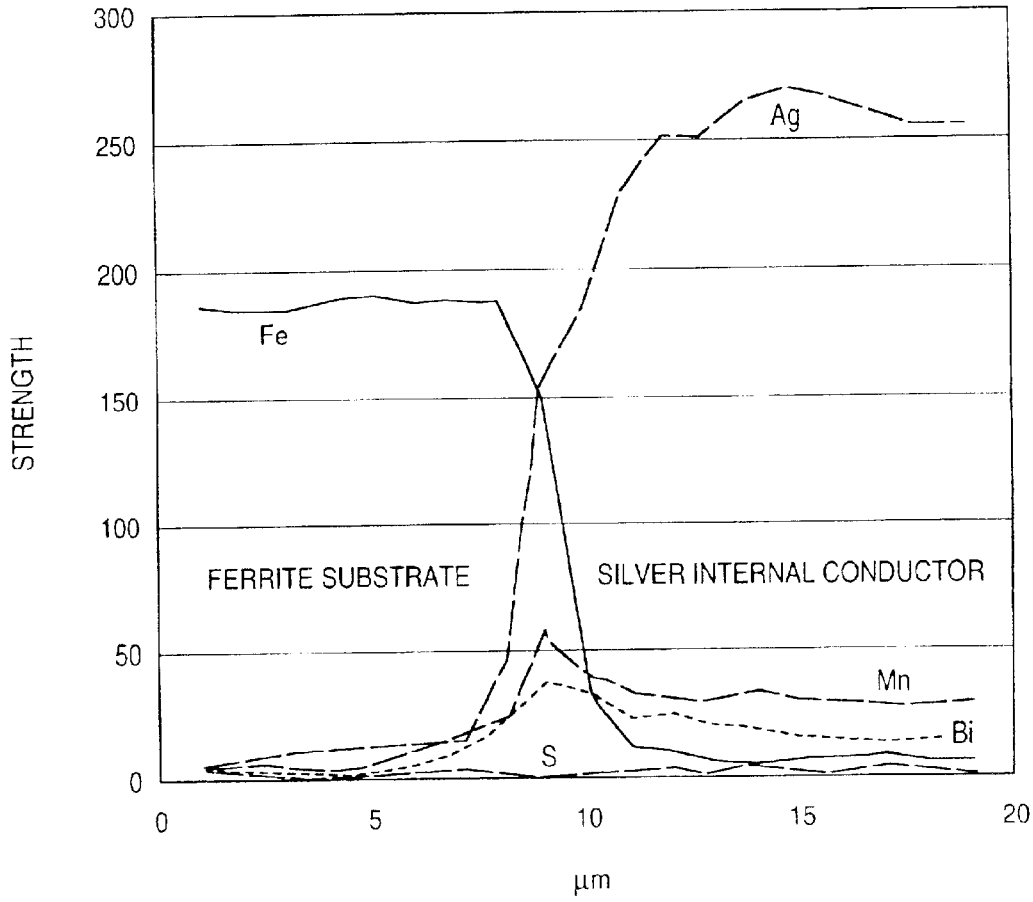
FIG. 2 is a view showing measured results of element distribution by EPMA at the interface between the internal conductors and the substrate.

FIG. 2 shows the measured results of the element distribution by EPMA at the interface between the internal conductor 2 and the substrate 1 when adding $MnO_2$ 0.05 wt % and $Bi_2O_3$ 0.8 wt %. From FIG. 2, it is seen that manganese and bismuth are concentrated at the interface, and since sulfur is scarcely traced, the plating liquid containing sulfur was scarcely invaded in the space between the internal conductor and the substrate.

Table 1 shows values of impedance when using silver for the internal conductors 2, before and after the plating at different amounts of $MnO_2$ and $Bi_2O_3$, and after the soldering tests. Table 2 shows values of impedance when using silver-palladium alloy substituting for silver, before and after the plating at different amounts of $MnO_2$ and $Bi_2O_3$, and after the soldering tests. Each impedance is an average value when using 10 pieces of the internal conductors as to each of addition amounts.

TABLE 1

Relationship between $MnO_2$ and $Bi_2O_3$ additive amounts and impedance in internal conductor made of silver

| | | | | | | | | | |
|---|---|---|---|---|---|---|---|---|---|
| $MnO_2$ (wt %) | 0 | 0.02 | 0.05 | 0.1 | 0.12 | 0.01 | 0.02 | 0.05 | 0.07 |
| $Bi_2O_3$ (wt %) | 0 | 0.3 | 0.3 | 0.3 | 0.3 | 0.5 | 0.5 | 0.5 | 0.5 |
| Before plating (Ω) | 355 | 489 | 488 | 476 | 490 | 398 | 602 | 605 | 610 |
| After plating (Ω) | 505 | 510 | 515 | 501 | 520 | 530 | 611 | 607 | 612 |
| After soldering | 574 | 582 | 594 | 561 | 620 | 592 | 622 | 620 | 631 |

TABLE 1-continued

Relationship between $MnO_2$ and $Bi_2O_3$ additive amounts and impedance in internal conductor made of silver test (Ω)

| | | | | | | | | | |
|---|---|---|---|---|---|---|---|---|---|
| $MnO_2$ (wt %) | 0.10 | 0.12 | 0.01 | 0.02 | 0.05 | 0.07 | 0.10 | 0.12 | 0.01 |
| $Bi_2O_3$ (wt %) | 0.5 | 0.5 | 0.8 | 0.8 | 0.8 | 0.8 | 0.8 | 0.8 | 1.0 |
| Before plating (Ω) | 601 | 485 | 490 | 590 | 622 | 635 | 630 | 480 | 500 |
| After plating (Ω) | 611 | 613 | 510 | 611 | 623 | 635 | 635 | 617 | 578 |
| After soldering test (Ω) | 622 | 626 | 594 | 621 | 625 | 634 | 642 | 648 | 603 |
| $MnO_2$ (wt %) | 0.02 | 0.05 | 0.07 | 0.10 | 0.12 | 0.01 | 0.05 | 0.10 | 0.12 |
| $Bi_2O_3$ (wt %) | 1.0 | 1.0 | 1.0 | 1.0 | 1.0 | 1.2 | 1.2 | 1.2 | 1.2 |
| Before plating (Ω) | 590 | 615 | 610 | 603 | 480 | 505 | 580 | 690 | 477 |
| After plating (Ω) | 611 | 616 | 610 | 620 | 597 | 579 | 597 | 613 | 622 |
| After soldering test (Ω) | 622 | 618 | 611 | 625 | 631 | 615 | 602 | 615 | 635 |
| $MnO_2$ (wt %) | 0.02 | 0.05 | 0.12 | | | | | | |
| $Bi_2O_3$ (wt %) | 1.5 | 1.6 | 1.5 | | | | | | |
| Before plating (Ω) | 434 | 510 | 310 | | | | | | |
| After plating (Ω) | 548 | 601 | 423 | | | | | | |
| After soldering test (Ω) | 611 | 625 | 441 | | | | | | |

TABLE 2

Relationship between $MnO_2$ and $Bi_2O_3$ additive amounts and impedance in internal conductor made of silver palladium

| | | | | | | | | | |
|---|---|---|---|---|---|---|---|---|---|
| $MnO_2$ (wt %) | 0 | 0.02 | 0.05 | 0.1 | 0.12 | 0.01 | 0.02 | 0.05 | 0.07 |
| $Bi_2O_3$ (wt %) | 0 | 0.3 | 0.3 | 0.3 | 0.3 | 0.5 | 0.5 | 0.5 | 0.5 |
| Before plating (Ω) | 333 | 411 | 490 | 475 | 504 | 418 | 600 | 602 | 605 |
| After plating (Ω) | 514 | 498 | 519 | 513 | 552 | 520 | 609 | 608 | 612 |
| After soldering test (Ω) | 598 | 567 | 577 | 555 | 611 | 594 | 620 | 622 | 630 |
| $MnO_2$ (wt %) | 0.10 | 0.12 | 0.01 | 0.02 | 0.05 | 0.07 | 0.10 | 0.12 | 0.01 |
| $Bi_2O_3$ (wt %) | 0.5 | 0.5 | 0.8 | 0.8 | 0.8 | 0.8 | 0.8 | 0.8 | 1.0 |
| Before plating (Ω) | 602 | 454 | 471 | 590 | 620 | 618 | 606 | 467 | 489 |
| After plating (Ω) | 610 | 604 | 513 | 507 | 623 | 620 | 612 | 607 | 580 |
| After soldering test (Ω) | 618 | 626 | 591 | 620 | 623 | 620 | 631 | 630 | 599 |
| $MnO_2$ (wt %) | 0.02 | 0.05 | 0.07 | 0.10 | 0.12 | 0.01 | 0.05 | 0.10 | 0.12 |
| $Bi_2O_3$ (wt %) | 1.0 | 1.0 | 1.0 | 1.0 | 1.0 | 1.2 | 1.2 | 1.2 | 1.2 |
| Before plating (Ω) | 594 | 616 | 618 | 605 | 487 | 500 | 585 | 587 | 455 |
| After plating (Ω) | 621 | 616 | 617 | 610 | 597 | 572 | 599 | 612 | 600 |
| After soldering test (Ω) | 628 | 617 | 617 | 622 | 630 | 610 | 607 | 617 | 632 |
| $MnO_2$ (wt %) | 0.02 | 0.05 | 0.12 | | | | | | |
| $Bi_2O_3$ (wt %) | 1.5 | 1.5 | 1.5 | | | | | | |
| Before plating (Ω) | 422 | 510 | 380 | | | | | | |
| After plating (Ω) | 533 | 600 | 493 | | | | | | |

TABLE 2-continued

| | Relationship between $MnO_2$ and $Bi_2O_3$ additive amounts and impedance in internal conductor made of silver palladium | | |
|---|---|---|---|
| After soldering test (Ω) | 610 | 621 | 516 |

Figure 3:
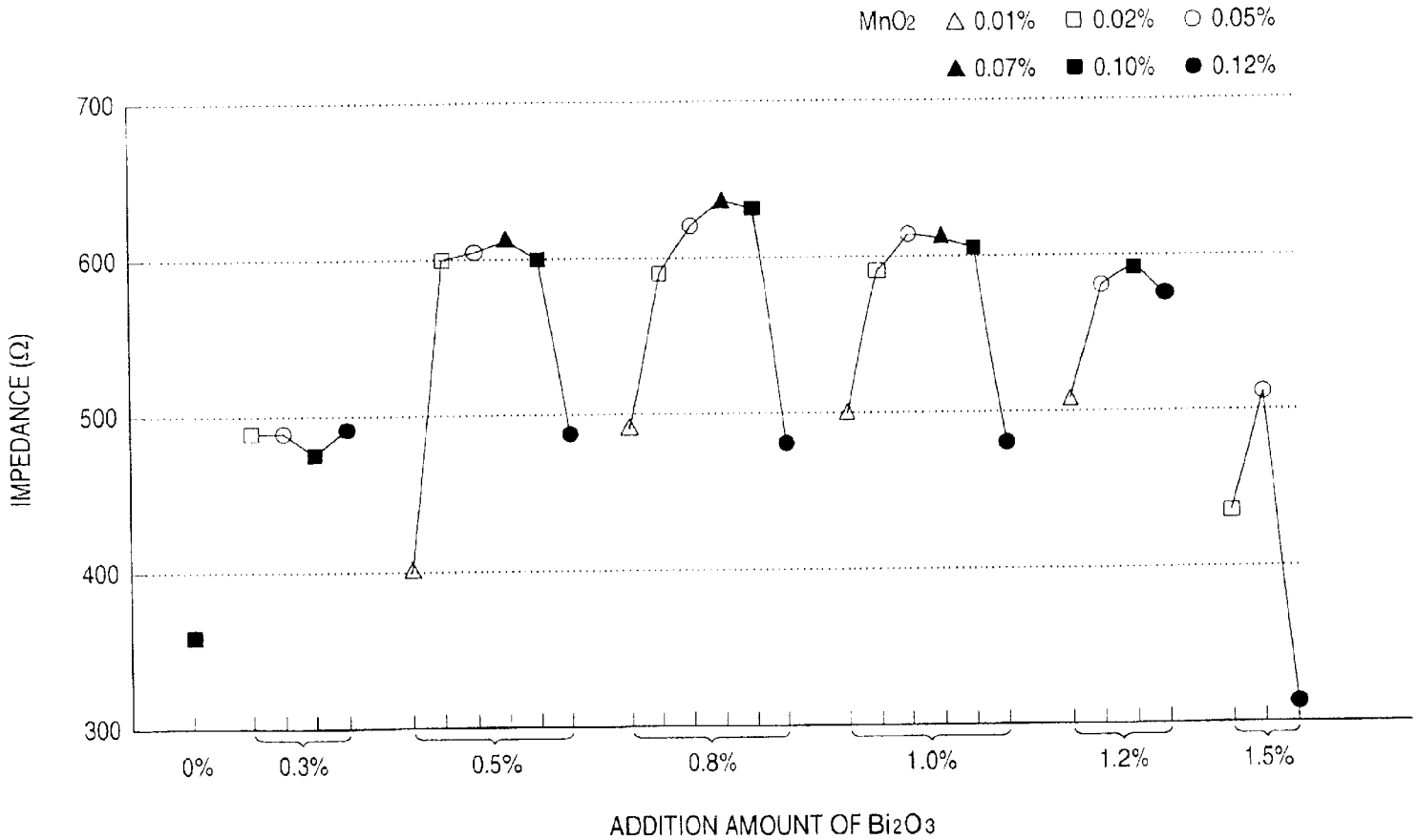
FIG. 3 graphs the relationship between the addition amounts of $MnO_2$ and $Bi_2O_3$ and impedance in the multilayer inductor where silver shown in Table 1 was used to the internal conductor.
Figure 4:
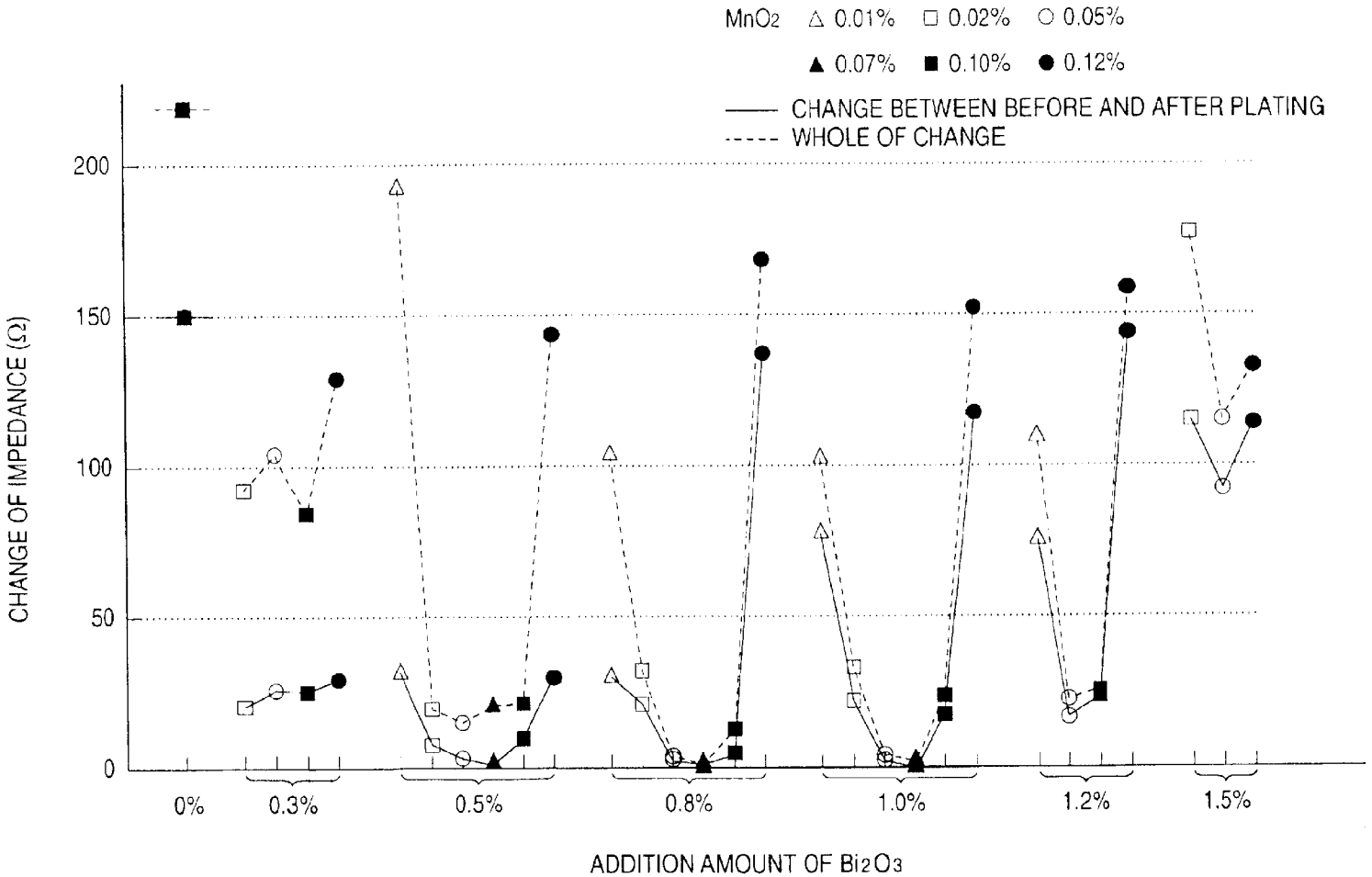
FIG. 4 graphs the relationship between the addition amounts of $MnO_2$ and $Bi_2O_3$, change of impedance and change of the whole impedance by plating in the multilayer inductor where silver shown in Table 1 was used to the internal conductor.

FIG. 3 graphs the relationship between the addition amounts of $MnO_2$ and $Bi_2O_3$ and impedance in the multilayer inductor where silver shown in Table 1 was used for the internal conductor. FIG. 4 graphs the relationship between the addition amounts of $MnO_2$ and $Bi_2O_3$, change of impedance and change of the whole impedance by plating in the multilayer inductor where silver shown in Table 1 was used for the internal conductor.

As is seen from FIG. 3, by adding $MnO_2$ 0.02 to 0.1 wt % and $Bi_2O_3$ 0.5 to 1.2 wt %, and baking the paste and the spinel ferrite material at the same time, impedance of around 580 Ω or more can be obtained. In this range, the changing amount of impedance by plating and soldering can be controlled to be 50 Ω or lower.

Figure 5:
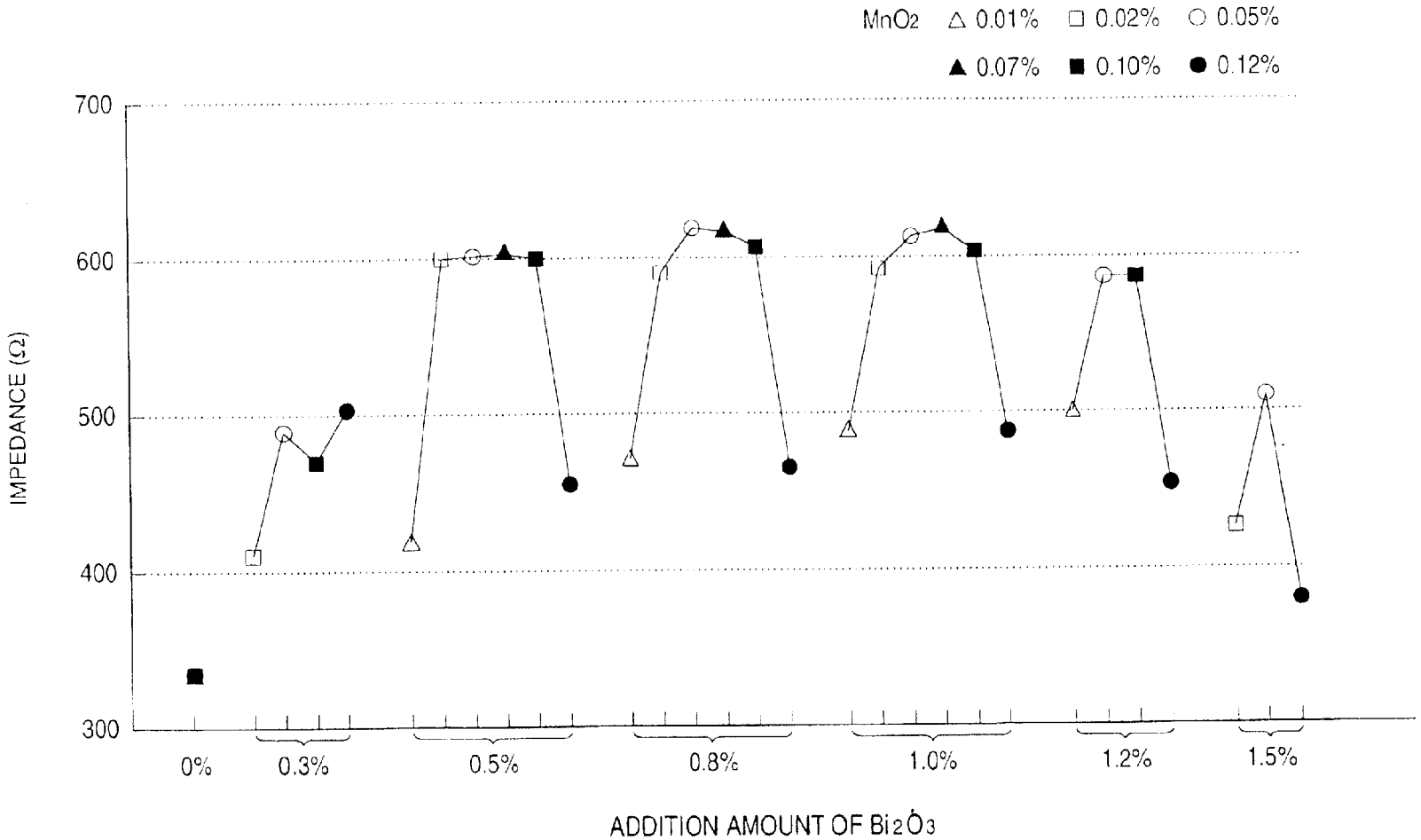
FIG. 5 graphs the relationship between the addition amounts of $MnO_2$ and $Bi_2O_3$ and impedance in the multilayer inductor where silver-palladium shown in Table 2 was used to the internal conductor.
Figure 6:
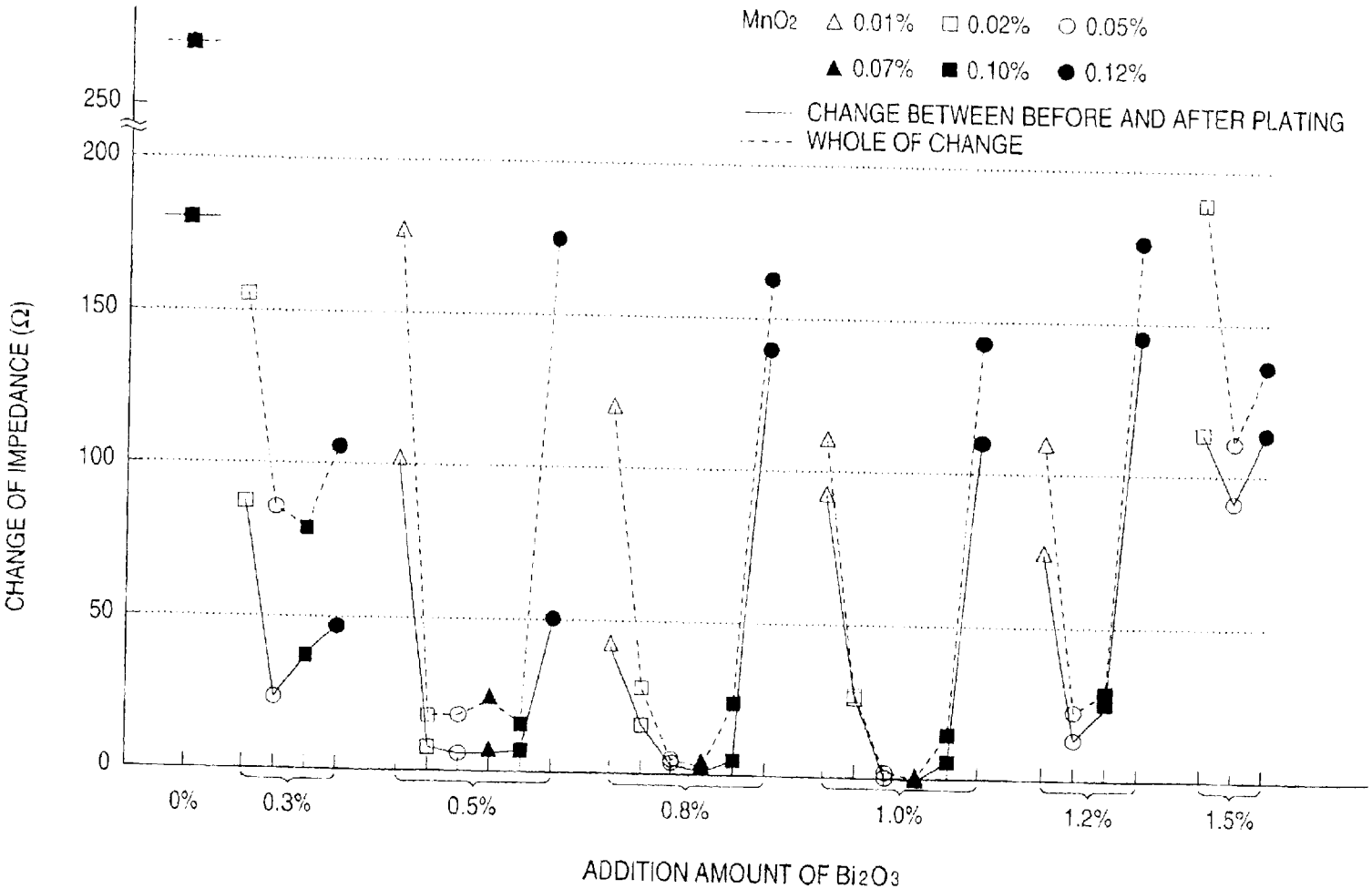
FIG. 6 graphs the relationship between the addition amounts of $MnO_2$ and $Bi_2O_3$, change of impedance and change of the whole impedance by plating in the multilayer inductor where silver-palladium shown in Table 2 was used to the internal conductor.
Figure 7:
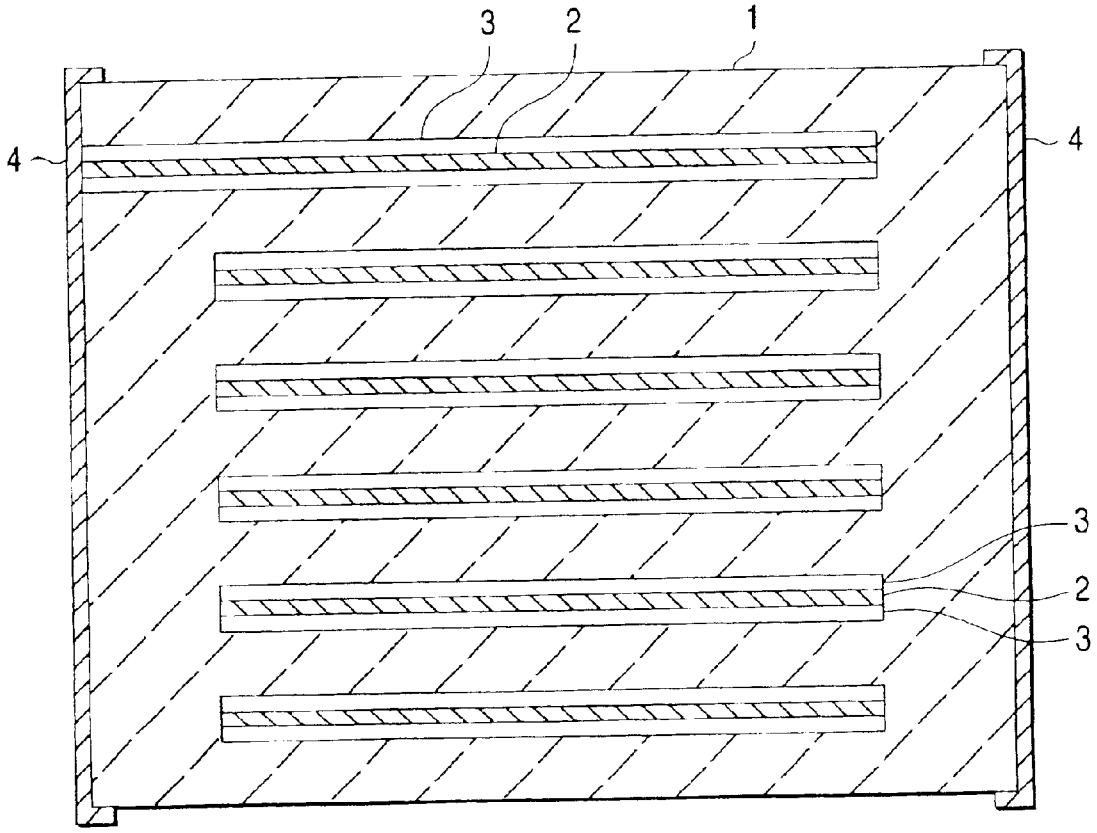
FIG. 7 is a cross sectional view showing one example of the prior art multilayer inductor.

FIG. 5 graphs the relationship between the addition amounts of $MnO_2$ and $Bi_2O_3$ and impedance in the multilayer inductor where silver-palladium shown in Table 2 was used for the internal conductor. FIG. 6 graphs the relationship between the addition amounts of $MnO_2$ and $Bi_2O_3$, change of impedance and change of the whole impedance by plating in the multilayer inductor where silver-palladium shown in Table 2 was used for the internal conductor.

As is seen from FIGS. 5 and 6, also in the case where silver-palladium was used for the internal conductor 2, by adding $MnO_2$ 0.02 to 0.1 wt % and $Bi_2O_3$ 0.5 to 1.2 wt %, and baking the paste and the spinel ferrite material at the same time, impedance of around 580 Ω or more can be obtained. In this range, the changing amount of impedance by plating and soldering can be controlled to be 50 Ω or lower.

When evaluating values of the impedance, an influence of stress exerted at the interface between the internal conductor 2 and the substrate 1 (ferrite) is reflected to the values of impedance before the plating. If the stress at the interface is eased, the value of impedance is large.

When the stress at the interface is eased, the value of impedance is large. If the plating liquid invades into the space along the interface between the internal conductor 2 and the substrate 1, the interface is affected with etching, and moderation of the stress at the interface is progressed. However, in this case, the plating liquid remains on the interface, undesirably taking reliability for a long period of time into consideration. Further, if the interface is unstable and when the laminated chips are immersed in the soldering chamber, the stress is more moderated. If a degree of this moderation is large, it is not desirable in the reliability for a long period of time. If the stress has already been moderated immediately after baking, the value of impedance must not be changed even if passing through the plating treatment or immersing into the soldering chamber, and this is preferable. In fact, in the examples, the values of impedance before the plating are high and hardly changed by passing through the plating treatment or immersing into the soldering chamber. From these situations, it is suggested that if bismuth and manganese exist at the interface between the internal conductor and the substrate, the stress therebetween is moderated, so that it is possible to offer the multilayer inductors having the stable characteristics for long period of time without affecting of invasion of the plating liquid.

According to the invention, in the multilayer inductor composed of the internal conductors of main components being the spinel ferrite and silver, there are formed parts of much contents of manganese and bismuth at the interface between the internal conductors and the substrate, whereby the stress exerted at the interface is eased, and the inductor of excellent characteristics is available, so that it is possible to offer the multilayer inductors having the stable characteristics for long period of time without affecting of invasion of the plating liquid so that the characteristic is prevented from deterioration by the invasion of the plating liquid.

What is claimed is:

1. A method of making a multilayer inductor comprising adding 0.02 to 0.1 wt % $MnO_2$ and 0.5 to 1.2 wt % $Bi_2O_3$ to a paste corn rising silver to yield an internal conductor paste;

drawing the internal conductor paste outside of a substrate; and baking the internal conductor paste and the substrate.

2. The method of claim 1, wherein the $MnO_2$ is added in amount of 0.05 to 0.07 wt %.

3. The method of claim 2, wherein the $Bi_2O_3$ is added in amount of 0.8 to 1.0 wt %.

4. The method of claim 1, wherein the $Bi_2O_3$ is added in amount of 0.8 to 1.0 wt %.

5. The method of claim 1, wherein the paste comprises a silver-palladium alloy.

6. The method of claim 1, wherein the substrate is a spine ferrite material.

7. The method of claim 6, wherein the spinel ferrite material is a $NiCuZnFe_2O_4$ based component.

* * * * *